US010094540B2

(12) United States Patent
Scordino et al.

(10) Patent No.: US 10,094,540 B2
(45) Date of Patent: Oct. 9, 2018

(54) LIGHTING ASSEMBLY

(75) Inventors: Alessandro Scordino, Dolo (IT); Franco Zanon, Cassola (IT)

(73) Assignee: OSRAM GmbH, Munich (DE)

( * ) Notice: Subject to any disclaimer, the term of this patent is extended or adjusted under 35 U.S.C. 154(b) by 233 days.

(21) Appl. No.: 13/882,469

(22) PCT Filed: Oct. 25, 2011

(86) PCT No.: PCT/EP2011/068622

§ 371 (c)(1),
(2), (4) Date: Jun. 4, 2013

(87) PCT Pub. No.: WO2012/055852

PCT Pub. Date: May 3, 2012

(65) Prior Publication Data

US 2013/0265779 A1 Oct. 10, 2013

(30) Foreign Application Priority Data

Oct. 29, 2010 (IT) ..... TO2010A0870

(51) Int. Cl.

| | |
|---|---|
| ***F21V 7/04*** | (2006.01) |
| ***F21V 19/00*** | (2006.01) |
| ***F21V 23/00*** | (2015.01) |
| ***F21K 9/20*** | (2016.01) |
| *F21Y 115/10* | (2016.01) |

(52) U.S. Cl.

CPC ..... *F21V 19/00* (2013.01); *F21K 9/20* (2016.08); *F21V 19/001* (2013.01); *F21V 23/006* (2013.01); *F21Y 2115/10* (2016.08)

(58) Field of Classification Search

CPC ..... F21V 15/01; F21V 23/003
USPC ..... 362/368, 646
See application file for complete search history.

(56) References Cited

U.S. PATENT DOCUMENTS

| | | | | |
|---|---|---|---|---|
| 5,909,955 | A * | 6/1999 | Roorda | 362/368 |
| 6,502,968 | B1 * | 1/2003 | Simon | 362/489 |
| 8,021,017 | B2 * | 9/2011 | Cheng | 362/249.02 |
| 8,152,355 | B2 * | 4/2012 | Wang | 362/647 |
| 8,157,422 | B2 * | 4/2012 | Paik et al. | 362/294 |
| 8,272,762 | B2 * | 9/2012 | Maxik et al. | 362/249.02 |
| 8,328,386 | B2 * | 12/2012 | Catalano | H05B 33/0809 362/187 |
| 8,540,414 | B2 * | 9/2013 | Hu | 362/650 |
| 8,702,294 | B2 * | 4/2014 | Lee et al. | 362/612 |
| 2005/0128744 | A1 * | 6/2005 | You et al. | 362/241 |
| 2008/0123341 | A1 * | 5/2008 | Chiu | 362/294 |
| 2008/0212332 | A1 | 9/2008 | Medinis | |

FOREIGN PATENT DOCUMENTS

| | | |
|---|---|---|
| CN | 101688660 | 3/2010 |
| DE | 10 2008 016 095 | 10/2009 |

* cited by examiner

*Primary Examiner* — Bryon T Gyllstrom
(74) *Attorney, Agent, or Firm* — Cozen O'Connor

(57) ABSTRACT

A lighting assembly, comprising: a casing having a bowl-like structure with a bottom wall defining a window opening; a radiation source board with a light radiation source situated opposite said opening so as direct said light radiation outside of the casing; and a driving circuit board for said radiation source, said boards being stacked together without air gaps in between, with said circuit board directed towards said casing.

17 Claims, 2 Drawing Sheets

LIGHTING ASSEMBLY

RELATED APPLICATIONS

This is a U.S. national stage of International application No. PCT/EP2011/068622 filed on Oct. 25, 2011.

This patent application claims the priority of Italian application no. TO 2010A000870 filed Oct. 29, 2010, the disclosure content of which is hereby incorporated by reference.

FIELD OF THE INVENTION

The present description relates to lighting assemblies. In various embodiments, the description refers to lighting assemblies which can be used for example for lighting applications based on the use of LED light radiation sources.

BACKGROUND OF THE INVENTION

In the technical sector in question various designs of lighting assemblies are known, these assemblies requiring fairly complex electrical and/or mechanical connections and the use of additional components and processes (for example the provision of cables, gluing processes, etc.), such that they give rise to somewhat complicated production processes which may be affected by major problems as regards manufacturing tolerances.

This gives rise to bulky designs which, for example, are unable to take advantage of the compact features which are offered by the use of LED light radiation sources, for example based on Chip-on-Board (CoB) technology.

OBJECT AND SUMMARY OF THE INVENTION

In various embodiments, the description deals with the problem of overcoming the drawbacks mentioned above.

The object is thus that of being able to offer, in various embodiments, at least one of the following advantages:

an optimized assembly structure for producing compact ("slim") lighting structures for example of the LED type;

integration between the operative parts (for example as regards the thermal and electrical functions) and mounting parts (for example as regards the electronics);

a standardized, stable and reliable assembly structure;

the possibility of performing assembly of the electronic parts by means of soldering, avoiding the use of cables and connectors, and the possibility of ensuring that the tolerances between the parts allow efficient adjustment of the entire structure.

In various embodiments, this object is achieved by means of a lighting assembly having the characteristic features which are described specifically in the claims below.

The claims form an integral part of the technical teaching provided here in relation to the invention.

In various embodiments, it is possible to employ a compact structure for joining together boards (for example of the printed circuit board (PCB) type) stacked together without air gaps in between and being fixed and aligned by means of a suitably shaped casing.

In various embodiments, a multiple board (multi-PCB) structure may be formed by an electronic control circuit board provided for example with flexible elements (of the type known as "Starflex") and stacked on a main board able to be "populated" with a set of LEDs, for example organized in an array, namely using Chip-on-Board (CoB) technology.

In various embodiments, the resultant structure may be a sandwich structure composed of several boards able to be mechanically fixed and adjusted.

In various embodiments, the shape of the driving board may be adapted to relevant devices mounted on the main board, such as an LED system of the CoB type.

In various embodiments it is possible to solder a board of the Starflex type onto the CoB board, for example by means of a hot-bar or laser-soldering process. In this way the flexible connection between the boards may easily absorb small movements and/or vibrations of the structure, with a consequent improvement in the mechanical strength properties of the structure itself.

In addition to this, in various embodiments, being able to dispense with wires for connecting the electronic components to the CoB chip may allow the electrical connection to be arranged at a distance from the LED source, thereby optimizing the optical design of the casing and providing a greater free area around the LEDs, for example around the CoB chip.

In various embodiments the casing may be provided with pins in order to fix the boards by means of mechanical interference and/or at the same time align the boards.

In various embodiments, by using screws to fix together all the components (boards and casing) of the structure, sleeves (bushes) may be used so that the screws act on one or more of the boards only via the sleeves, reducing and virtually eliminating the mechanical stresses acting on the multiple-board structure.

In various embodiments it is possible to create a gap or slot between the surface of the pins and the circuit board so as to avoid any mechanical pressure produced by the screws used to fix the assembly. In various embodiments, this result can be achieved by adjusting the tolerances associated with the following parameters:

distance between the base of the bush and the internal surface of the casing;

height of the circuit board on which the driver is mounted;

joining together of the main board (the board with the light radiation source) and the board with the driver.

The invention described is able to provide a structure having at least one of the following characteristic features:

the connection between the driving circuit board and the main board with the light source is simpler and more reliable both in terms of positioning and in terms of fixing method;

in view of the possibility of using Starflex technology, no other components (e.g. cables, screws, adhesives, etc.) are required in order to connect the boards;

the manufacturing tolerances of the parts ensure an efficient alignment of the entire structure;

the structure is stable and reliable both from a mechanical point of view and from an electrical point of view;

the stacked board structure may be populated with different families of devices (of the surface mounting technology (SMT), through-hole or Chip-on-Board type);

wired connections are not required;

the electrical connection may be arranged at a certain distance from the CoB chip;

the radio frequency disturbances (electromagnetic interference (EMI)) affecting the components of the driving electronics are not influenced by the main CoB board; and an optical sensor may be arranged on the driving board (for example made of FR4 material) for reliable measurements of the flow, in such a way that it is not influenced by heat dissipation of the LEDs;

BRIEF DESCRIPTION OF THE DRAWINGS

The invention will now be described, purely by way of a non-limiting example, with reference to the accompanying figures in which.

DETAILED DESCRIPTION OF THE DRAWINGS

In the following description various specific details aimed at providing a fuller understanding of the embodiments are described. The embodiments may be implemented without one or more of the specific details or using other methods, components, materials, etc. In other cases, known structures, materials or operations are not shown or described in detail so that the various aspects of the embodiments may be understood more clearly.

The reference to "an embodiment" in the context of this description indicates that a particular configuration, structure or characteristic feature described in relation to the embodiment is included in at least one embodiment. Therefore, phrases such as "in an embodiment", which may occur at various points in this description, do not necessarily refer to the same embodiment.

Moreover, particular forms, structures or characteristic features may be combined in any suitable manner in one or more embodiments.

The reference numbers used here are provided solely for the sake of convenience and therefore do not define the scope of protection or the ambit of the embodiments.

Figure 1:
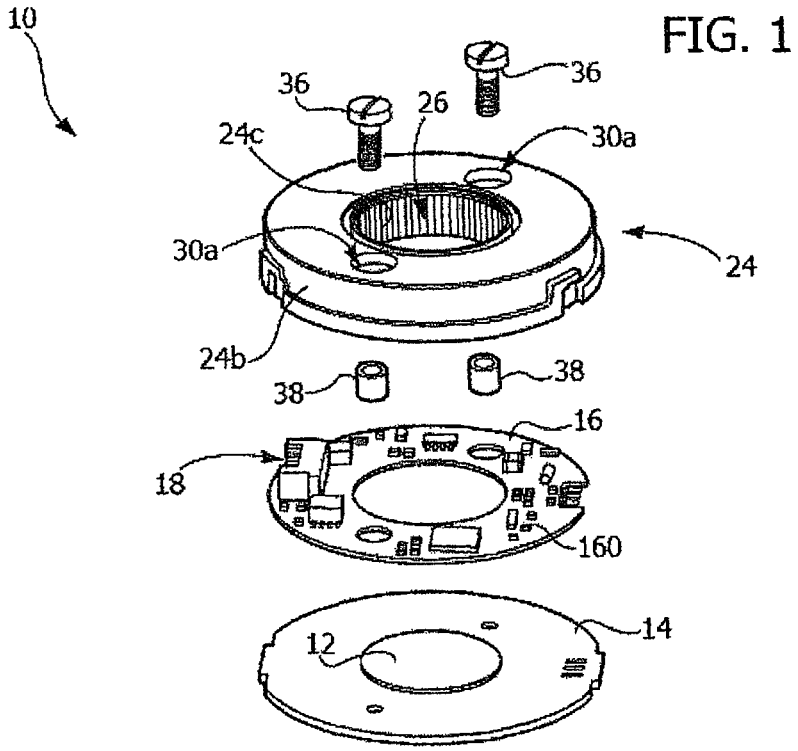
FIG. 1 is a view of an embodiment shown in an exploded condition.

In FIG. 1 the reference number 10 denotes overall a lighting assembly.

Various embodiments comprise, for example, a lighting assembly which uses an LED light source as a light radiation source. In various embodiments, the source may be in the form of a set 12 of LEDs which are mounted using "Chip-on-Board" technology on a support board 14.

In the embodiments considered here by way of a non-limiting example, the set of LEDs 12 is shown schematically in the form of a circular shaped board mounted on a similarly circular plate or board 14. The reference to this particular embodiment must not be interpreted as limiting in any way the scope of the description.

In various embodiments, the board 14 may be for example of the type with a metal core.

In various embodiments, the light radiation source 12, 14 is able to cooperate with a circuit board 16 (for example a printed circuit board (PCB) on which electronic components 160 are mounted) able to be provided with one or more connectors 18 so as to provide an electric power supply to the LEDs 12 and, if necessary, allow the transmission of control sig-nals and/or transfer outside of the assembly 10 detection or sensing signals supplied by a flow sensor.

As already mentioned, in various embodiments, the board 14 may be of the type with a metal core so that the board 14 is able to act not only as a base body for the assembly 10, but also partly as a heat sink for dissipating externally the heat produced by the LEDs during operation.

In various embodiments, the board 14 (with the LEDs 12) and the board 16 (with the electronic circuits 160 for driving and controlling the LEDs 12) may therefore form a compact combined structure in which the boards in question are stacked together without air gaps in between, being fixed and aligned by means of a casing to which they are joined.

In various embodiments, the boards 14 and 16 may give rise to a multiple-board (multi-PCB) structure comprising the electronic control circuit board 16 and the main board 14 ("populated" with arrays of LEDs which are formed for example using Chip-on-Board (CoB) technology). The resultant structure is therefore a sandwich structure consisting of several boards, which may be mechanically fixed and adjusted.

In various embodiments, the shape of the driving board 16 may be adapted to devices mounted on the main board 14, such as an LED system of the CoB type.

In various embodiments, in order to establish the electrical connection between the circuit board 16 and the board 14 with the radiation source 12, one (or more) connection elements 19 may be soldered. In various embodiments these consist of flexible connection elements, of the type commonly known as Starflex, which are applied onto the CoB board, for example by means of a hot-bar or laser-soldering process.

The flexible connection between the boards 19 may easily absorb small movements and/or vibrations of the structure, with a consequent improvement in the mechanical strength properties of the structure itself.

The reference number 24 denotes a casing in its entirety which is for example made of molded plastic and has, in various embodiments, a bowl-like structure.

In various embodiments the device 10 may have overall a disk-like shape. In various embodiments, such as that shown here, the casing 24 may have a shape which may be described as being "doughnut-like".

The choice of this particular form must not, however, be interpreted as being obligatory for the purposes of implementation of the embodiments. In various embodiments, the casing 24 (and therefore the assembly 10 as a whole) may have a different form, for example a square, rectangular or prism-like shape.

In various embodiments, in addition to an outer peripheral wall 24*b*, the bottom wall 24*a* may be bounded internally by a wall 24*c* defining a window 26 (which is central in the embodiments considered here by way of example) having, at least partly facing it, in the mounted assembly 10, the array of LEDs 12, i.e. the light radiation source. The light radiation emitted by the LEDs 12 is therefore able to be emitted to the outside of the assembly 10 through the window 26.

Figure 2:
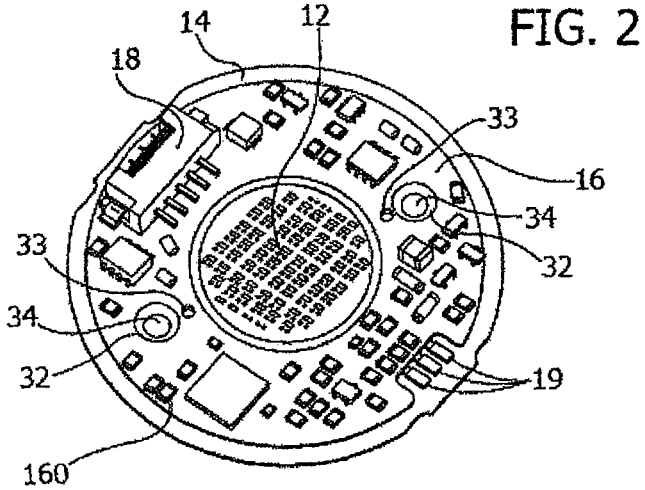
FIG. 2 is a perspective view of part of an embodiment.

In the embodiments considered here by way of example—see in particular FIG. 2—the stack formed by the boards 14 and 16 is such that the board 16 is mounted against the board 14 without air gaps in between, namely in contact with the board 14, with the set of LEDs 12 left exposed by the board 16, which has a ring-like shape with a central opening intended to be aligned with the window 26 of the casing 24.

With such an embodiment it is thus possible to obtain a stack of reduced height, having practically a height which is equal to the sum of the thicknesses of the boards 14 and 16.

In various embodiments, the stack formed by the board 14 and by the board 16 is intended to be fitted in an end position onto the internal wall formation 24*c* of the casing 24. Therefore, in the mounted assembly 10, the board 14 acts in practice as a lid or cover for the casing 24 with the board 16 applied against the board 14 so as to be arranged between the bottom wall 24*a* and the board 14, so that:

the components 160 mounted on the board 16 are housed inside the internal volume (which may be annular or doughnutlike in the embodiment considered here) of the casing 24; and the LEDs 12 mounted on the board 14 are left exposed by the board 16 and situated opposite the window 26 so that the radiation produced by them is transmitted to the outside of the casing 24.

Figure 3:
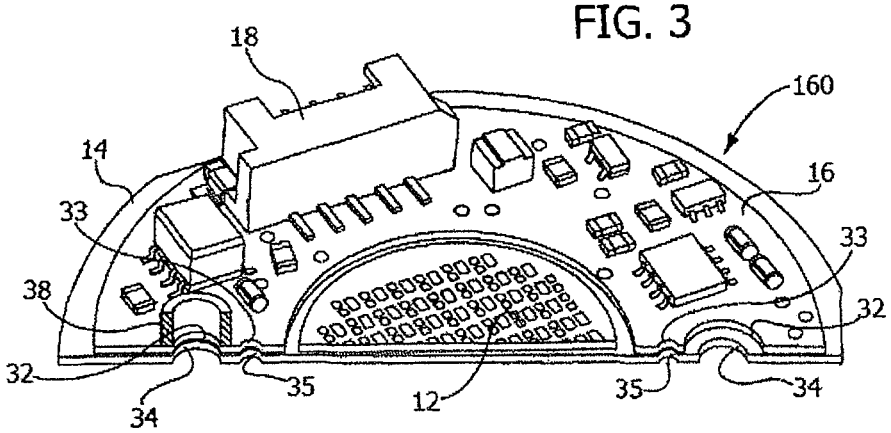
FIGS. 3 to 5 show various details of embodiments.
Figure 5:
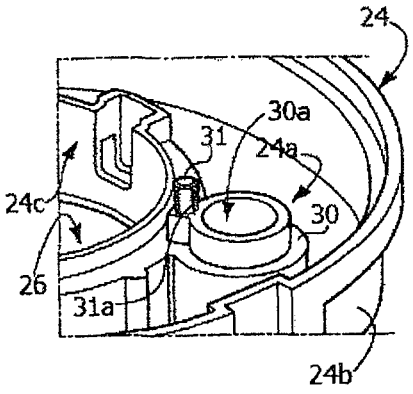
Figure 6:
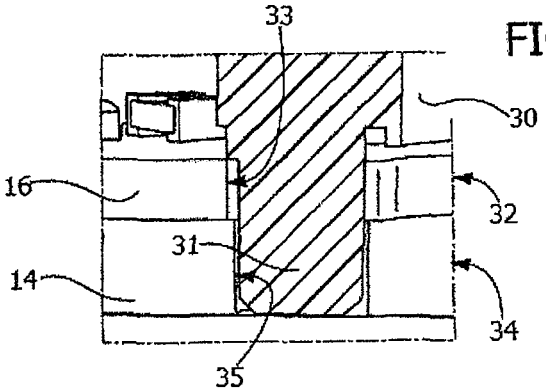
FIG. 6 is a view, on an enlarged scale, of a part also visible in FIG. 4.

With reference to FIG. 5 (which is essentially a view "from below" of the casing 24), the possible presence, within the said casing 24, of engaging formations, for example in the form of pins 30, 31, may be noted. These formations protrude from the bottom wall 24*a* of the casing 24 and are intended to extend through corresponding openings provided in the board 16 (for example in the form of holes 32, 33) aligned with corresponding holes 34 and 35 provided in the board 14—see for example FIG. 3, which shows the stack of boards 14 and 16 in a view ideally cut-away in the middle.

In the embodiments considered here by way of example, the pins 31 pass through the holes 33 and extend inside the holes 35 acting as centering elements. The pins 31 may optionally be provided with axial ribs 31*a* able to produce, together with the holes 33 and/or 35 through which they pass, an interference fit so as to help keep the two boards 14 and 16 together.

In the embodiments considered here, the pins 30 pass through the openings 32 until they rest in a distal position against the board 14 and each have, passing through them, an axial cavity 30*a* for receiving a screw 36 which is able to engage inside a corresponding opening 34 in the board 14 so as to allow fixing of the casing 24 to the board 14.

Figure 4:
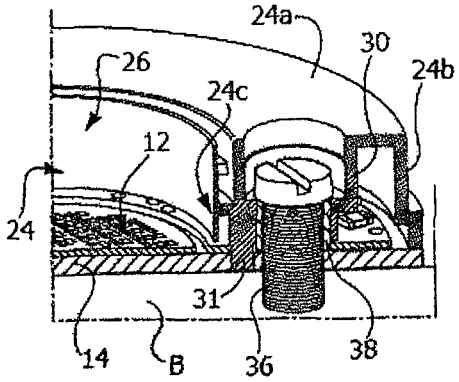

In various embodiments, the screws 36 may pass completely through the respective opening 34 in the board 14 in the axial direction (also without being screwed into it) and also extend further so as to allow fixing of the assembly 10 as a whole on a support B (FIG. 4) such as a heat sink/support.

In various embodiments, bushes or sleeves 38 are fitted around the screws 36 so as to ensure that the screws 36 act on the board 16 (and where necessary also on the board 14) only via the bushes, thereby reducing and virtually eliminating the mechanical stresses on the multiple-board structure.

In various embodiments it is also possible to choose the axial length of the pins 30 so as to create a gap or slot between the front surface of the pins 30 and the circuit board so as to avoid any mechanical pressure on the board 16 produced by the screws 36 used to fix the assembly.

Obviously, without affecting the principle of the invention, the embodiments and the details of construction may vary, also significantly, with respect to that illustrated here purely by way of a non-limiting example, without thereby departing from the scope of the invention as defined in the accompanying claims.

The invention claimed is:

1. A lighting assembly comprising:

a casing; and a support, the casing and the support arranged to define:

an open central volume having its entire periphery defined by an inner wall of the casing, and wherein the support within said open central volume is uncovered by the casing, and a closed peripheral volume around said open central volume;

wherein:

said open central volume defines a window opening of the casing and has a light radiation source mounted thereon and situated opposite said window opening so as to direct its light radiation outside of said casing; and said support has mounted thereon within the closed peripheral volume components configured to drive and/or control said radiation source, and wherein said components configured to drive and/or control said radiation source are arranged only within said closed peripheral volume and said light radiation source is arranged only within said open central volume.

2. The assembly as claimed in claim 1, wherein said casing has a generally ring-like shape.

3. The assembly as claimed in claim 1, wherein the support comprises:

a radiation source board with said light radiation source mounted thereon; and a driving circuit board having mounted thereon said components configured to drive and/or control said radiation source.

4. The assembly as claimed in claim 3, further comprising flexible connecting elements configured to electrically connect together said radiation source board and said driving circuit board.

5. The assembly as claimed in claim 3, wherein said driving circuit board has a ring-like shape surrounding said window opening with said radiation source board having at least one part extending so as to close said peripheral volume of said casing.

6. The assembly as claimed in claim 3, wherein said window opening is surrounded by a wall formation of said casing with said radiation source board and said driving circuit board fitted onto said wall formation.

7. The assembly as claimed in claim 3, wherein said casing has formations configured to engage said radiation source board and said driving circuit board.

8. The assembly as claimed in claim 7, wherein said engaging formations comprise pins protruding from said casing.

9. The assembly as claimed in claim 8, wherein said pins comprise pins configured to extend through openings provided in both said radiation source board and said driving circuit board.

10. The assembly as claimed in claim 8, wherein said pins comprise pins with cavities passed through by fixing elements which are configured to extend through openings provided in said radiation source board.

11. The assembly as claimed in claim 10, further comprising bushes fitted around said fixing elements so that said fixing elements act on at least one of said radiation source board and said driving circuit board only via said bushes.

12. The assembly as claimed in claim 10, wherein a gap or slot is present between the end surface of said pins with cavities and said driving circuit board.

13. The assembly as claimed in claim 8, wherein said pins comprise pins configured to extend with an interference fit through openings provided in both said radiation source board and said driving circuit board.

14. The assembly as claimed in claim 8, wherein said pins comprise pins with cavities passed through by fixing elements of the screw type, which are configured to extend through openings provided in said radiation source board.

15. The assembly as claimed in claim 7, wherein said engaging formations comprise pins protruding from said bottom wall of said casing.

16. The assembly as claimed in claim 3, wherein said radiation source board and said driving circuit board are stacked together without air gaps in between.

17. The assembly as claimed in claim 1, wherein said light radiation source has one or more LEDs.

* * * * *